US011905726B2

(12) United States Patent
Karsten et al.

(10) Patent No.: US 11,905,726 B2
(45) **Date of Patent: *Feb. 20, 2024**

(54) POOL COVER SYSTEM AND METHOD OF DELIVERY OF THE POOL COVER SYSTEM

(71) Applicant: North Star Technology Limited, Birkirkara (MT)

(72) Inventors: Toby Karsten, Sparta, IL (US); Drew Marlow, Knoxville, TN (US)

(73) Assignee: North Star Technology Limited, Birkirkara (MT)

( * ) Notice: Subject to any disclaimer, the term of this patent is extended or adjusted under 35 U.S.C. 154(b) by 0 days.

This patent is subject to a terminal disclaimer.

(21) Appl. No.: 18/135,029

(22) Filed: Apr. 14, 2023

(65) Prior Publication Data

US 2023/0272635 A1 Aug. 31, 2023

Related U.S. Application Data

(63) Continuation of application No. 17/159,720, filed on Jan. 27, 2021, now Pat. No. 11,655,646.

(60) Provisional application No. 62/966,115, filed on Jan. 27, 2020.

(51) Int. Cl.
*E04H 4/06* (2006.01)

(52) U.S. Cl.
CPC ..... *E04H 4/06* (2013.01)

(58) Field of Classification Search
CPC ..... E04H 4/08; E04H 4/082; E04H 4/101; E04H 4/06
See application file for complete search history.

(56) References Cited

U.S. PATENT DOCUMENTS

| | | | | |
|---|---|---|---|---|
| 7,318,243 | B2 * | 1/2008 | Smith | E04H 4/082 4/502 |
| 2002/0133871 | A1 * | 9/2002 | Bertoni | E04H 4/101 4/502 |
| 2006/0123536 | A1 * | 6/2006 | Smith | E04H 4/101 4/502 |

OTHER PUBLICATIONS

Pool Warehouse. http://www.poolwarehouse.com/automatic-swimming-pool-cover/ (Year: 2016).*
How to Assembly a Pool Cover Specialists Polymer/Vacuum Formed Housing. Available at https://www.youtube.com/watch?v=5E1HBvhkga4 (Year: 2012).*
Automatic Pool Cover's 365 Installation for Vinyl Liner Pools| Pre-Pour Phase. Available at https://www.youtube.com/watch?v=NxtTr258vh40 (Year: 2018).*
Latham Pools—Fiberglass Auto Cover Bundle. Available at https://www.youtube.com/watch?v=asmTbkSihLY (Year: 2016).*

* cited by examiner

*Primary Examiner* — Erin Deery
(74) *Attorney, Agent, or Firm* — Luedeka Neely, P.C.

(57) ABSTRACT

A unitary pool cover housing for assembling a pool cover system such that the housing and pool cover system may be substantially assembled at the manufacturing facility and delivered together for quick installation at the pool site.

19 Claims, 9 Drawing Sheets

POOL COVER SYSTEM AND METHOD OF DELIVERY OF THE POOL COVER SYSTEM

CROSS REFERENCE TO RELATED APPLICATIONS

This application claims priority to co-pending U.S. application Ser. No. 17/159,720 filed Jan. 27, 2021, entitled "Pool Cover System & Method of Delivery of the Pool Cover System," which claims priority to U.S. Provisional Application Ser. No. 62/996,115 filed Jan. 27, 2020, entitled "One-Piece Pool Cover Housing Assembly With Integrated Drive Mechanism & Accessories," the entire contents of both being incorporated herein by reference.

FIELD

This disclosure relates to the field of pool covers. More particularly, this disclosure relates to a pool cover system having a unitary housing and a method for delivering the pool cover system to a pool site with the pool cover components substantially pre-installed in the unitary housing.

BACKGROUND

An automated pool cover system generally includes a set of tracks running on both sides of a pool, a pool cover having a leading end that is mounted on opposite sides to the tracks, and a drive system for expanding and retracting the pool cover. A housing is used to store the drive system and other components of the pool cover system. The housing may be mounted to the deck surface of the pool or it may be installed in the ground around the pool.

The housing of current automated pool cover systems is delivered in multiple pieces of plastic such that the housing, drive system, and other components within the housing are required to be assembled on-site by the installer. This is time consuming for the installer. It also increases the chances that the installer makes a mistake when assembling the automated pool cover system.

What is needed is a pool cover system that is able to be more efficiently delivered and installed.

SUMMARY

According to one embodiment of the disclosure, a method of delivering a pool cover system includes forming a unitary housing having a first end and an open second end, the unitary housing including a bottom wall extending from the open first end to the open second end, a first side wall extending substantially perpendicular from the bottom wall, a second side wall opposite the first side wall extending substantially perpendicular from the bottom wall, and an open top such that the unitary housing forms a trough; assembling pool cover system components within the trough of the unitary housing at an assembling facility; and delivering the unitary housing with assembled pool cover system components from the assembling facility to a pool site for installation of the pool cover system.

According to some embodiments, the unitary housing is formed of fiberglass.

According to some embodiments, the first and second side wall include a reinforcement layer disposed between layers of fiberglass.

According to some embodiments, the method further includes securing end caps to the open first end and the open second end.

According to some embodiments, the forming step includes forming a plurality of unitary housings each having different lengths and the assembling step includes selecting one of the plurality of unitary housings based on length requirements for the pool site.

According to some embodiments, the method further includes securing a riser panel to the unitary housing and a lid panel to the riser panel prior to delivering the unitary housing with assembled pool cover system components to the pool site. According to some embodiments, the unitary housing includes a first flange extending from a top end of the first side wall and a second flange extending from a top end of the second side wall and the riser panel includes at least a first slot extending at least partially around the riser panel. According to this embodiment, the method further includes securing the riser panel to the unitary housing by connecting a first portion of each of a plurality of brackets to the first slot and a second portion of each of the plurality of brackets to one of the first flange and the second flange.

According to some embodiments, the positioning of the first slot in the riser panel is selected to correspond to coping dimensions of a pool such that a height in which an installer will pour concrete will be the same for both the pool and the riser panel.

According to some embodiments, the unitary housing includes a flange extending outward from a top end of the first side wall, the method further comprising securing a plurality of spaced apart support blocks on a bottom surface of the flange for securing ground stakes to the unitary housing during installation of the pool cover system at the pool site.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

DETAILED DESCRIPTION

The following description of preferred embodiments for this disclosure is presented for purposes of illustration and description. It is not intended to be exhaustive or to limit the disclosure to the precise form disclosed. Obvious modifications or variations are possible in light of the following teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure.

The present disclosure is directed to a pool cover system having a unitary pool cover housing that is intended to be used deliver the pool cover system to a pool site with the drive mechanism, pool cover, and other components already substantially installed within the housing. Thus, in contrast to current systems where the housing is delivered in multiple pieces of plastic with the housing, drive mechanism, and other components required to be assembled on-site by the installer, the pool cover system of the present disclosure allows the pool cover system to be delivered substantially pre-installed to the pool site.

Figure 1:
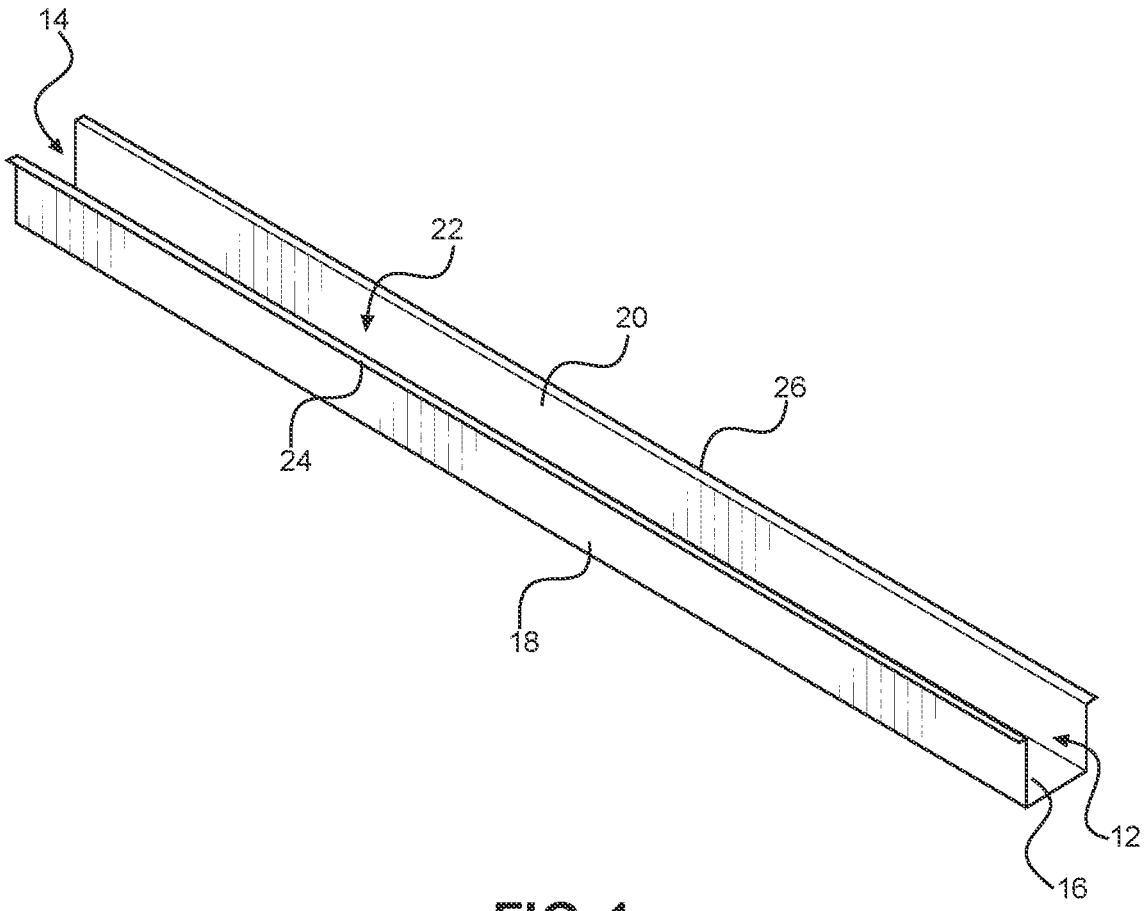
FIG. 1 depicts an overhead perspective view of a pool cover housing according to one embodiment of the disclosure.

With reference to FIG. 1, a one-piece, unitary housing 10 is depicted according to one embodiment of the disclosure. The housing is preferably formed of fiberglass in similar processes as fiberglass pools. As depicted, the housing of this embodiment preferably includes a first end 12, a second end 14, a bottom wall 16 extending from the first end 12 to the second end 14, and a pair of opposing side walls 18, 20 extending vertically from opposite sides of the bottom wall 16. The housing further includes an open top 22 and, thus, forms a generally U-shaped housing 10 with a trough for installing the various components of the pool cover system within the trough.

In preferred embodiments, the top of each of the side walls 18, 20 includes a flange 24, 26 extending out from the housing 10 (i.e., away from the open top 22). As explained further below, the flanges 24, 26 are intended to be used to help secure and riser panel to the housing 10 and to help position the housing with respect to a pool in which the pool cover system will be used.

In preferred embodiments, the width of the trough (i.e., width of the bottom wall 16) is between about 12 inches to about 16 inches while the depth of the trough is between about 12 inches to about 16 inches. Most preferably, the width of the trough is about 14 inches wide and the depth is about 14 inches deep. However, it should be understood that the width and depth of the trough is not critical to the embodiments of the present disclosure but is based on the dimensions needed to house the various components of the pool cover system in which the housing 10 is intended to be used.

In preferred embodiments, and as depicted in FIG. 1, the first end 12 and second end 14 of the unitary housing 10 are open (i.e., the unitary housing is formed without end walls). In this regard, it is preferable for the opposing side walls 18, 20 to extend substantially perpendicular from the bottom wall 16 to assist in having the pool cover components mounted to the side walls 18, 20 correctly. However, if the housing 10 is molded to include closed ends, it has been found to be difficult to pull the housing 10 from the mold without having the side walls 18, 20 extend from the bottom wall 16 at an angle greater than 90°. Including a housing having an open first end 12 and open second end 14 provides the ability of the side walls 18, 20 to flex outward slightly in order to help remove the housing 10 from the mold.

Figure 2:
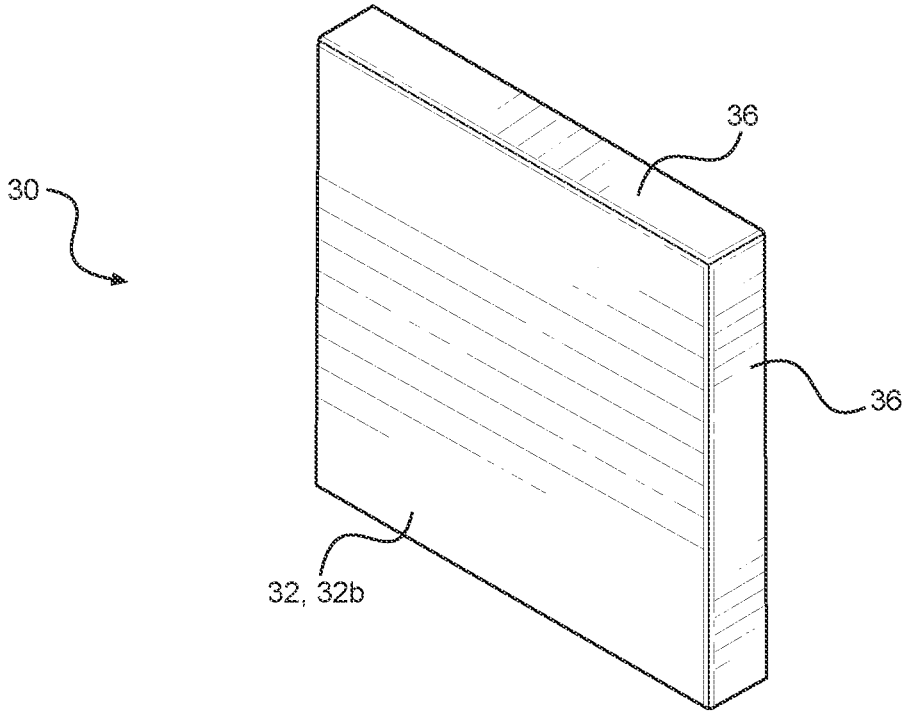
FIG. 2 depicts a first side perspective view of an end plate for the housing of FIG. 1 according to one embodiment of the disclosure.
Figure 3:
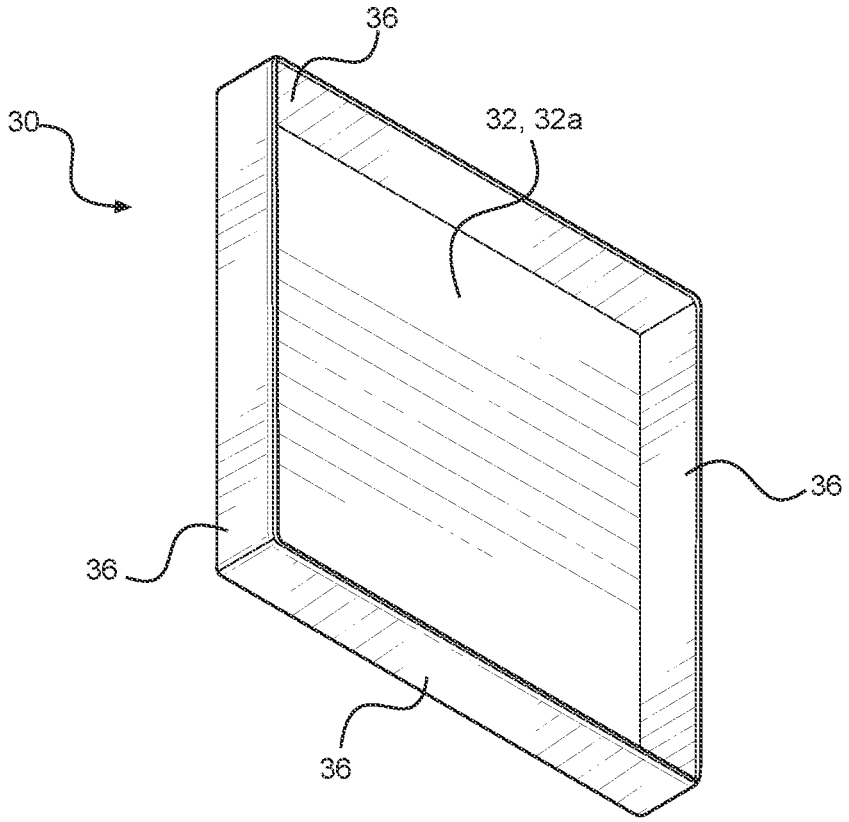
FIG. 3 depicts a second side perspective view of the end plate of FIG. 2 according to one embodiment of the disclosure.

With reference to FIGS. 2-3, an exemplary end plate 30 is depicted for closing the open ends 12, 14 of the housing of FIG. 1. In this embodiment, end plate 30 includes closing wall 32 including outer surface 32*a* (view of FIG. 3) and interior surface 32*b* (view of FIG. 2). A flange 36 is disposed around the closing wall 32 such that it extends from outer surface 32*a*. To secure the end plate 30 to an open end of the housing 10, the end plate is inserted into the open end with the flange 36 positioned towards the outside of the housing such that one side of flange 36 is able to be secured to the bottom wall 16 of housing 10, a second side of flange 36 is able to be secured to side wall 18 of the housing 10, a third side of flange 36 is able to be secured to the side wall 20 of the housing 10, and the fourth side of flange 36 forms the top of the particular end of the housing 10.

In practice, a plurality of unitary housings 10 with open ends 12, 14 are fabricated preferably with different lengths. Based on the size requirements of a particular job (i.e., size of the pool to which the pool cover will be used), a housing 10 with an appropriate length is selected. If the precise length is not available, a housing 10 with the closest but longer length is selected and the housing 10 is then trimmed to the appropriate length. For example, suppose a manufacturer decides to fabricate a plurality of housings in 16 ft, 18 ft, 20 ft, and 24 ft length options. If a particular order requires a housing 10 that is 19 ft in length, the 20 ft housing option can be selected and then at least one of its ends trimmed to form a housing 10 with a length of 19 ft. Two end plates 30 may then be used to close the open ends 12, 14 of the housing 10.

In an alternate embodiment, the unitary housing 10 is formed with only one open end. According to the embodiment, the housing could be cut to the desired length at its open end and then only one end plate is needed to close the open end. However, this embodiment is less desirable as only one open end makes the housing 10 more difficult to pull from its mold during fabrication. The unitary housing may also be formed with both ends closed. Again, this is considered less desirable due to the difficulties in removing the housing from its mold when the housing includes closed ends.

Figure 4:
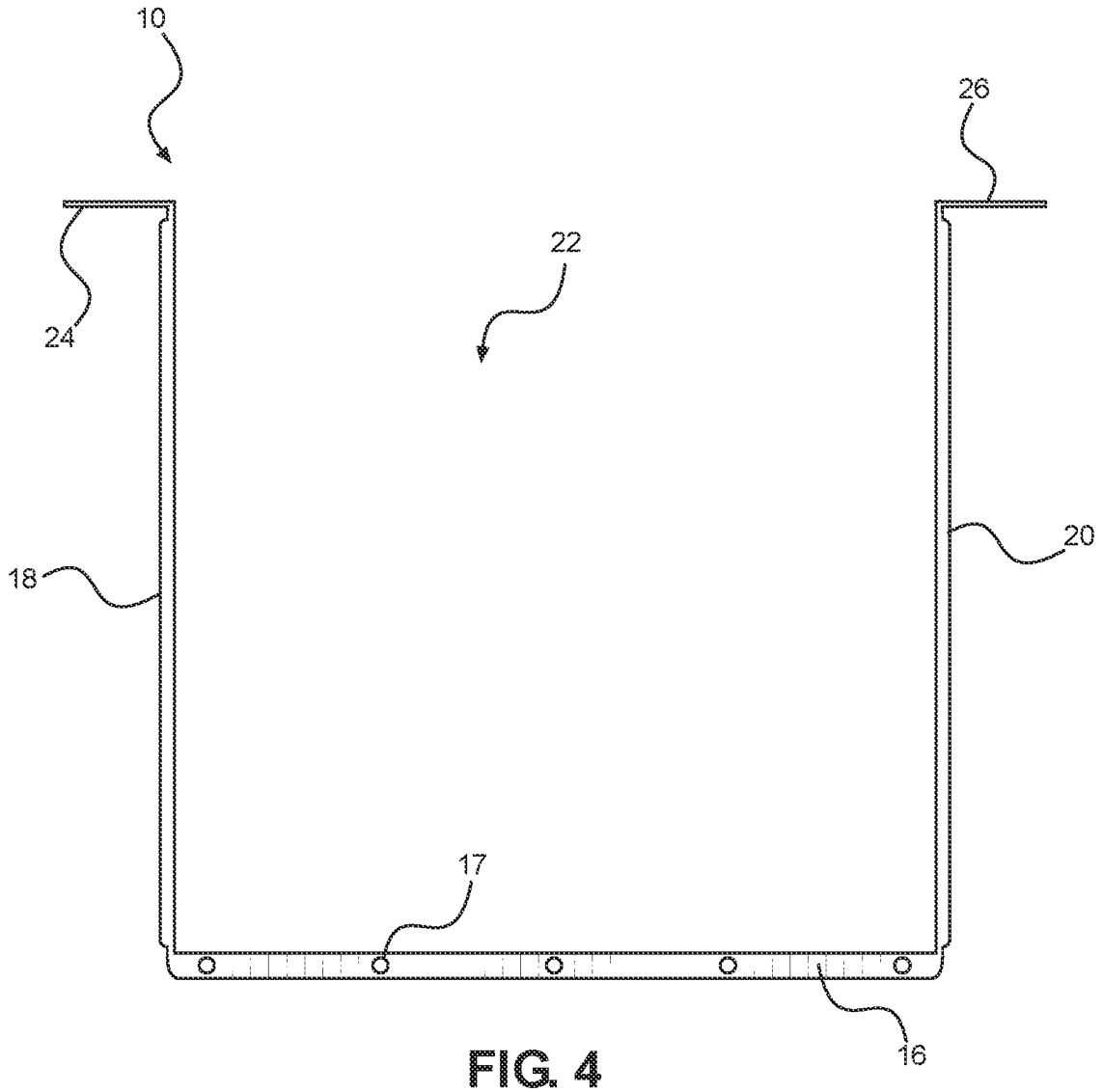
FIG. 4 depicts a cross-sectional view of a pool cover housing according to one embodiment of the disclosure.

Referring to FIG. 4, a cross section of the housing 10 according to one embodiment is depicted. According to this embodiment, side walls 18, 20 include added thickness/rigidity along at least a portion of the respective side wall. For example, each side wall 18, 20 could be formed by applying a layer of reinforcement material (such as thermoplastic honeycomb material or other lightweight honeycomb structure) to the outer portion of the shell and then applying one or more additional fiberglass layers to the housing over the reinforcement material. The additional thickness provides rigidity/strength to the side walls 18, 20 to help securely fasten pool cover system components to the wall interior. The additional thickness/rigidity also helps support the housing 10 with installed components during transport of the pool cover system.

With continued reference to FIG. 4, the bottom wall 16 of the housing 10 may also include additional thickness via a reinforcement material to strengthen the bottom of the housing. In certain embodiments, the reinforcement material could include enclosed metal rods/rebar 17 as depicted in FIG. 4. Similar to the added thickness of the side walls 18, 20, providing additional support to the bottom wall 16 would give the housing 10 additional strength to maximize its ability to be used as a shipping container for the pool cover system.

Figure 5:
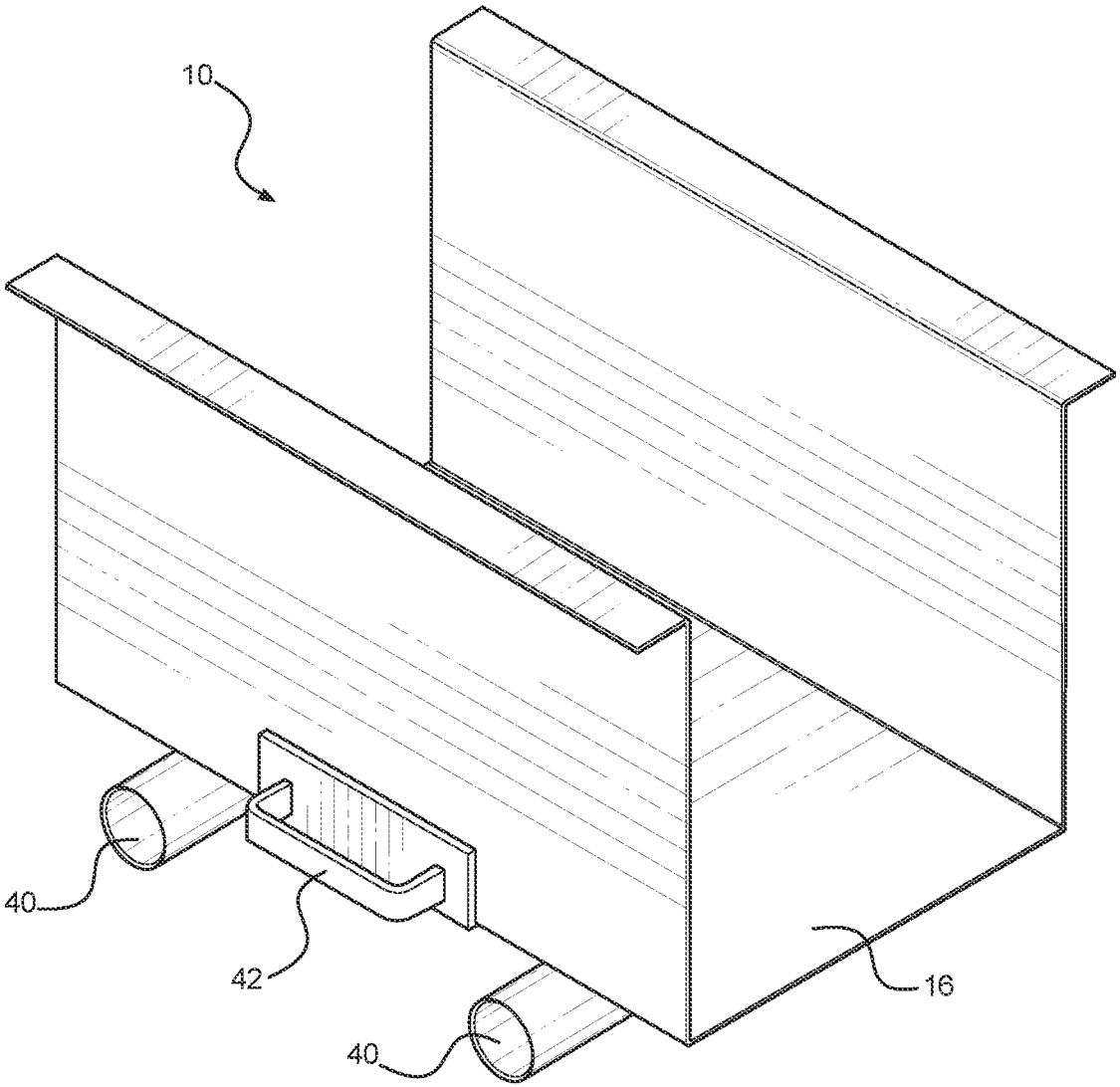
FIG. 5 depicts an overhead perspective view of a pool cover housing portion having handling structures according to one embodiment of the disclosure.

According to another aspect of the disclosure, housing 10 may include one or more handling structures attached to the housing to assist in lifting and moving the housing 10 both from the manufacturing facility to the pool site as well as at the pool site during installation. According to certain embodiments, and with reference to FIG. 5, the handling structures may include PVC tubes 40 attached to the outside bottom wall 16 of the housing 10. As shown, the tubes 40 would preferably be attached perpendicularly to the length of the housing 10, such as between every 3-5 feet, and would extend at least somewhat out from the footprint of the housing 10. In certain embodiments, caster wheels could be attached to the tubes to allow the housing to be rolled around as needed. The tubes 40 could be used as a pickup point such as with a forklift, crane, etc. With continued reference to FIG. 5, handles 42 may also be secured or molded to the sides of the housing 10 to assist in picking up the assembly, such as with crane straps for lifting of the housing with a crane.

Figure 6:
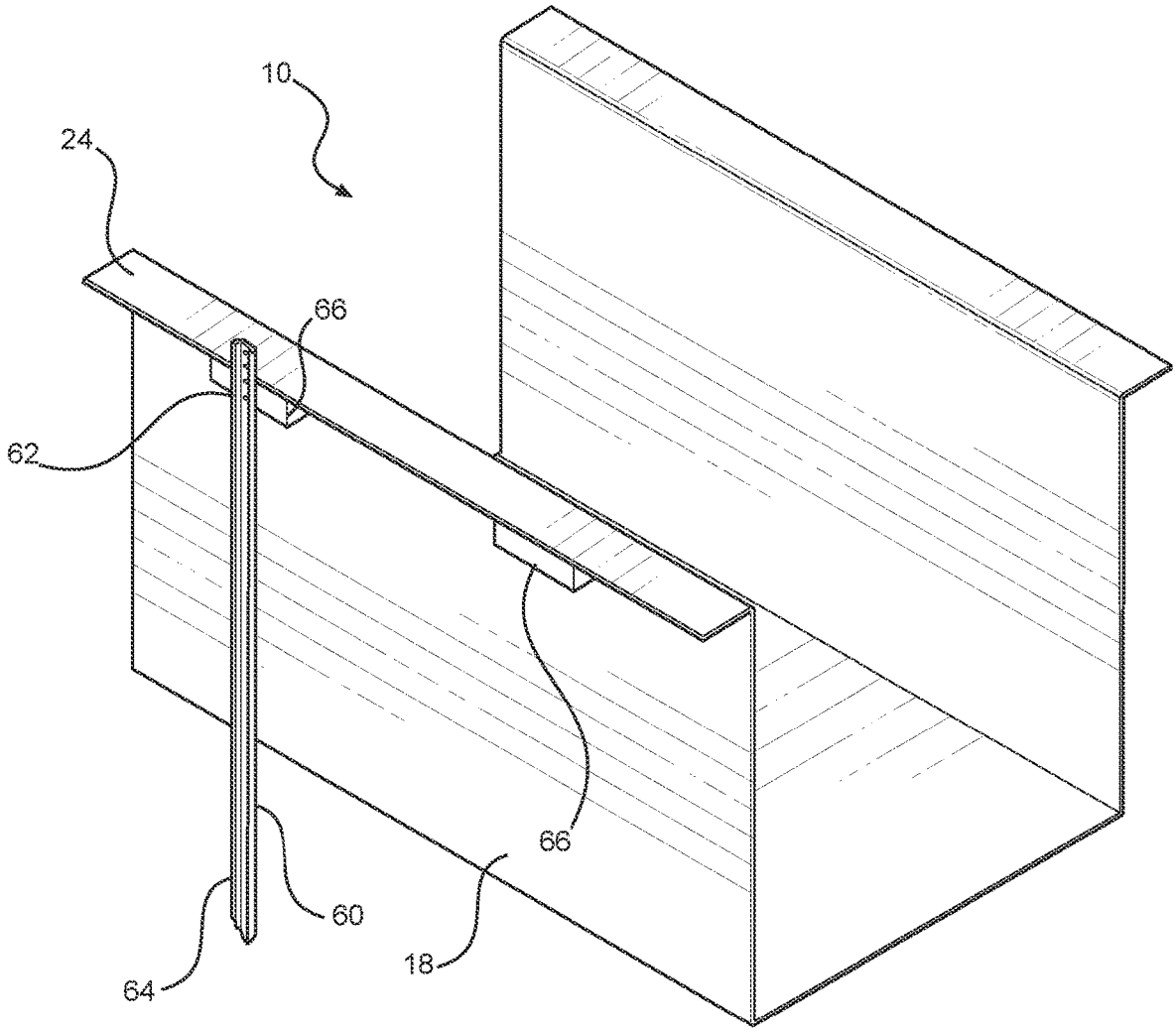
FIG. 6 depicts an overhead perspective view of a pool cover housing portion in which the flange on one side of the housing is used to secure the housing to the ground according to one embodiment of the disclosure.

With reference to FIG. 6, a portion of housing 10 is shown that includes flange 24 extending from side wall 18. In this embodiment, side wall 18 is intended to be positioned opposite the pool during installation. Flange 24 is then used to help secure the housing 10 in its final position with respect to the ground by drilling the bottom end 64 of stakes 60 into the ground while securing the top end 62 of stakes 60 to the flange 24. For example, according to the embodiment in FIG. 6, a plurality of support blocks 66 (e.g., strips of structural PVC board) are secured to the underside of flange 24 (such as by drilling or adhesive). The support blocks 66 are preferably spaced-apart by the manufacturer to ensure consistent staking along the length of the side wall 18. The bottom end 64 of each stake 60 is then drilled into the ground while the top end 62 is nailed or screwed into the support blocks 66. In an alternate embodiment, flange 24 could include spaced-apart apertures disposed through the flange 24. Stakes could then be driven through the apertures and into the ground for supporting the housing in position.

Figure 7:
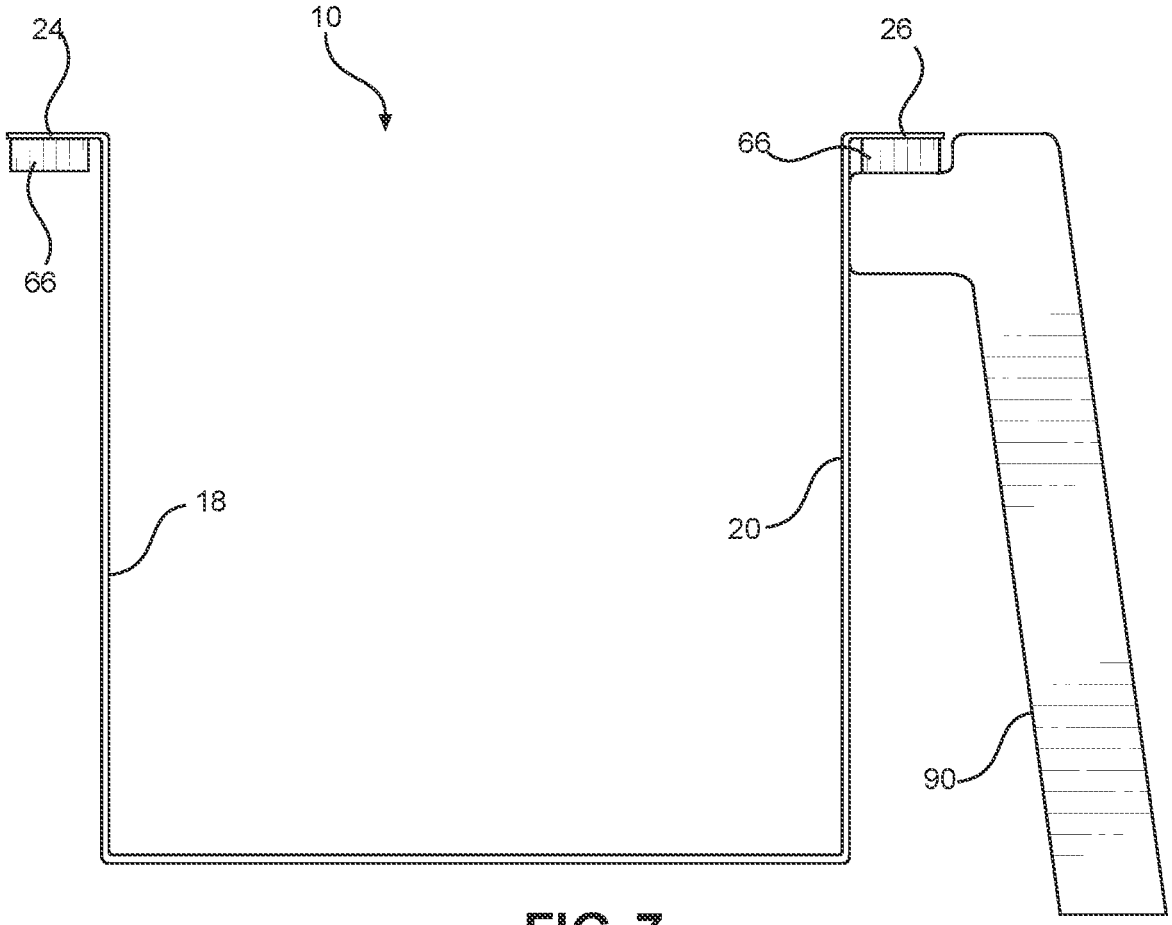
FIG. 7 depicts a cross-sectional view of a pool cover housing in which the flange on the other side of the housing as compared to FIG. 6 is used to position and support the housing with respect to the coping of a pool according to one embodiment of the disclosure.

With reference to FIG. 7, flange 26 of side wall 20 is used to properly position the housing 10 with respect to the pool 90 during installation. According to certain embodiments, flange 26 of side wall 20 also includes a spacer material (e.g., same PVC support blocks 66 described above with respect to FIG. 6) secured to the underside of the flange 26 that is used to rest the housing 10 on top of the pool 90 (e.g., rest flange 26 of housing 10 on the coping of a fiberglass pool). Further, as depicted in FIG. 6, the housing 10 is preferably sized and dimensioned such that the top surface of flange 26 is substantially level with the top surface of the pool 90 upon installation at the pool site.

Figure 8:
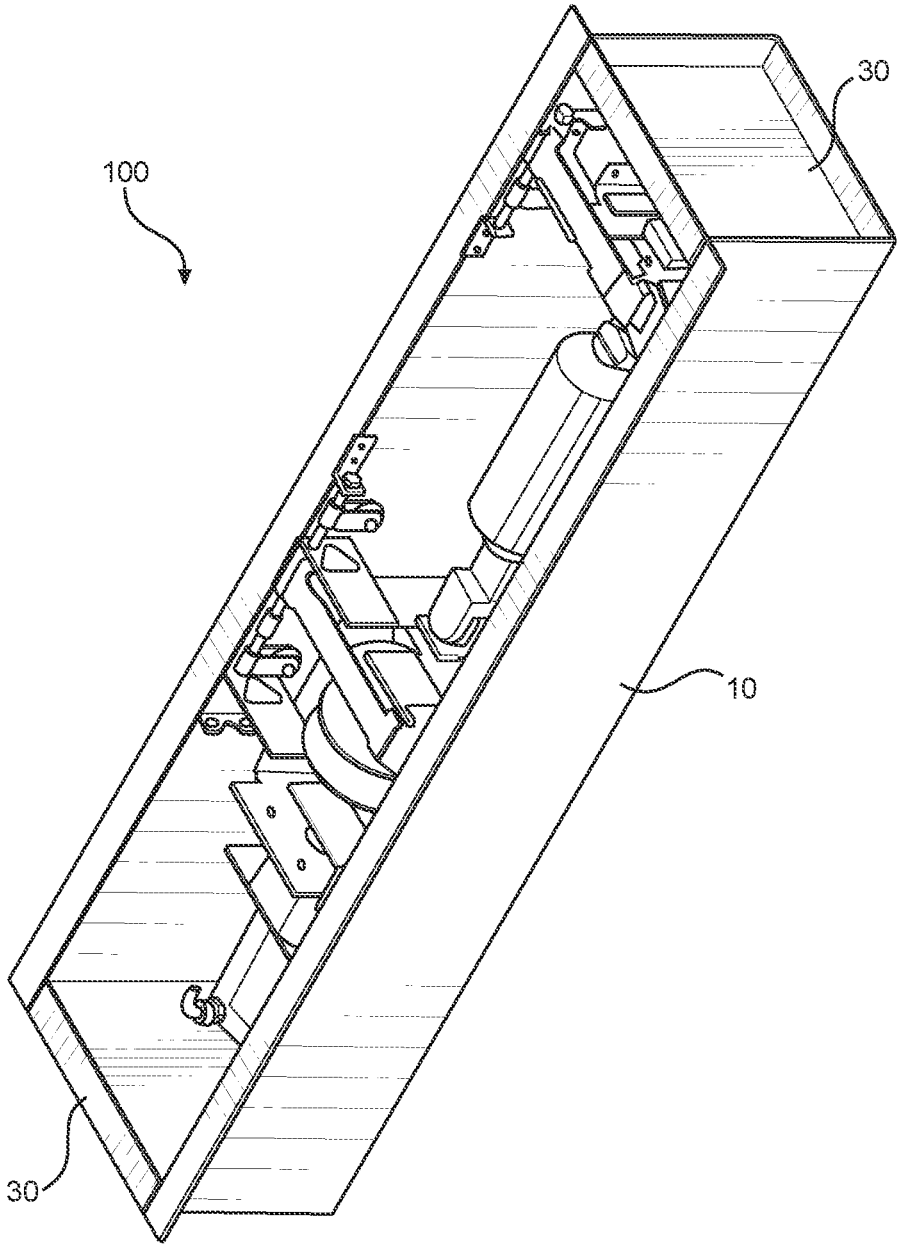
FIG. 8 depicts an overhead perspective view of a pool cover system with the components of the system installed in the trough of the housing according to one embodiment of the disclosure.

With reference to FIG. 8, an exemplary pool cover system 100 is depicted with unitary housing 10, end caps 30 installed at the ends 12, 14 of the housing 10, and the components of the pool cover system 100 installed in the trough of the housing 10. For purposes of the present disclosure, it should be understood that the particular components of the pool cover system installed in the housing 10 are not important as housing 10 of the present disclosure is intended to be able to be implemented with any number of automated pool cover systems and associated components.

Figure 9:
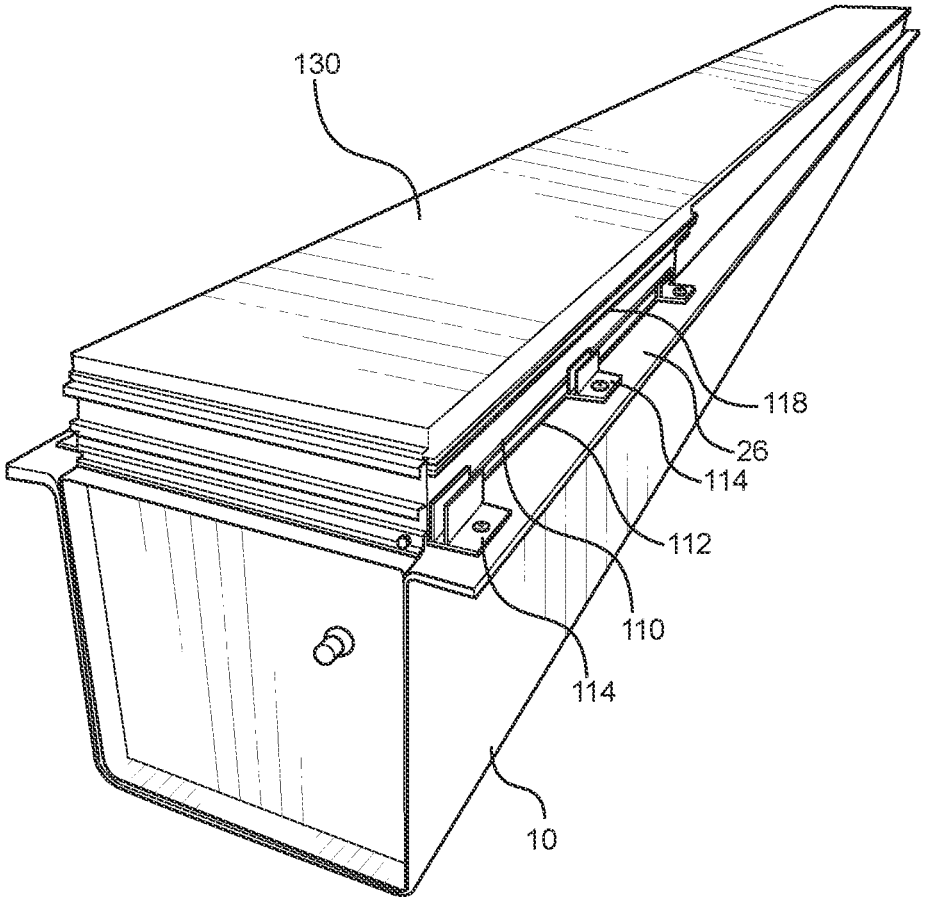
FIG. 9 depicts a perspective view of a pool cover system with a riser panel and lid panel secured to a pool cover housing according to one embodiment of the disclosure.
Figure 10:
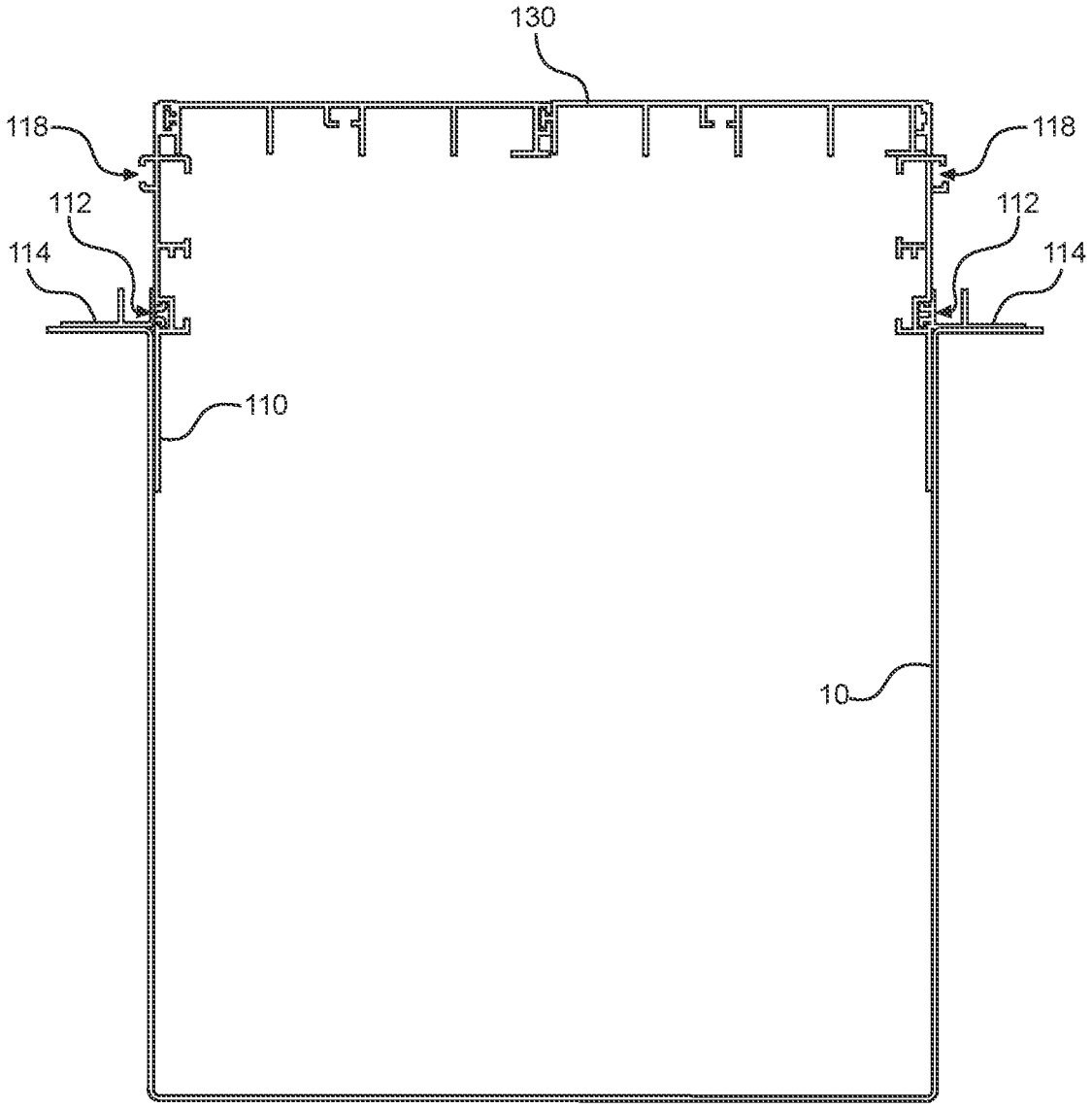
FIG. 10 depicts a cross-sectional view of a riser panel and lid panel secured to a pool cover housing according to one embodiment of the disclosure.

With reference to FIGS. 9-10, and according to another aspect of the disclosure, the pool cover system 100 includes a riser panel 110 (such as formed from aluminum extrusion) disposed above the housing 10 and a lid panel 130 (such as formed also from aluminum extrusion) on top of the riser panel 110. During installation at a pool site, concrete is poured around the riser panel 110 until the concrete is generally flush with the top of the riser panel 110. The lid panel 130 is then used to provide access to the pool cover components within the housing 10 when needed (e.g., for repair). The riser panel 110 and lid panel 130 also provide an enclosure for the housing 10 such that the housing 10 with pre-installed pool cover components are able to be shipped as a substantially installed unit while also protecting the pool cover components within the housing 10 during shipment.

To connect the riser panel 110 to housing 10, and with more specific reference to the cross-sectional view of FIG. 10, riser panel 110 of this embodiment includes a first slot 112 positioned around the exterior of the riser panel 110. A plurality of connecting brackets 114 may then be used to connect the riser panel 110 to the housing 10 by securing a first portion of bracket 114 to the first slot 112 and a second portion of bracket 114 to the flanges 24, 26 of housing 10. In preferred embodiments, the first slot 112 is positioned at a predetermined height that corresponds to the coping of the pool in which the pool cover system is intended to be used. More specifically, the predetermined height is determined such the height in which an installer will pour concrete around the pool coping will be the same height needed for the concrete to be flush with the top of the riser panel 110. Riser panel 110 may further include a second slot 118 in which to insert screws (not shown) that end up buried in the concrete poured around riser panel 110.

According to yet another aspect of the disclosure, brace bars may be secured to the inside of the housing to prevent the housing from being crushed/deformed during shipment/transport. For example, horizontal brace bars that are perpendicular to the length of the housing may be inserted every 3-5 feet or so to prevent the housing from being crushed/deformed inward during shipment/transport. The brace bars would also provide further rigidity to the housing when the installers backfill gravel and concrete around the housing/pool at the job sites.

What is claimed is:

1. A method of delivering a pool cover system:

providing a unitary fiberglass housing at a manufacturing facility, the unitary fiberglass housing including a bottom wall, a first side wall extending vertically upward from the bottom wall, a second side wall opposite the first side wall extending vertically upward from the bottom wall, and an open top such that the unitary fiberglass housing forms a trough;

assembling pool cover system components within the trough of the unitary fiberglass housing at the manufacturing facility, the assembling step including securing the pool cover system components to at least one of the first and second side wall; and delivering the unitary fiberglass housing with assembled pool cover system components from the manufacturing facility to a pool site for installation of the pool cover system, wherein the unitary fiberglass housing is used as a shipping container for the pool cover system during delivery to the pool site.

2. The method of claim 1 wherein the first and second side wall include a reinforcement layer disposed between layers of fiberglass.

3. The method of claim 1 wherein the forming step includes forming a plurality of unitary fiberglass housings each having different lengths and the assembling step includes selecting one of the plurality of unitary fiberglass housings based on length requirements for the pool site.

4. The method of claim 1 further comprising securing a riser panel to the unitary fiberglass housing and a lid panel to the riser panel prior to delivering the unitary fiberglass housing with assembled pool cover system components to the pool site.

5. The method of claim 4 wherein:

the unitary fiberglass housing includes a first flange extending from a top end of the first side wall and a second flange extending from a top end of the second side wall; and the riser panel includes at least a first slot extending at least partially around the riser panel, the method further comprising securing the riser panel to the unitary fiberglass housing by connecting a first portion of each of a plurality of brackets to the first slot and a second portion of each of the plurality of brackets to one of the first flange and the second flange.

6. The method of claim 5 wherein the positioning of the first slot in the riser panel is selected to correspond to coping dimensions of a pool such that a height in which an installer will pour concrete will be the same for both the pool and the riser panel.

7. The method of claim 1 wherein the unitary fiberglass housing includes a flange extending outward from a top end of the first side wall, the method further comprising securing a plurality of spaced apart support blocks on a bottom surface of the flange for securing ground stakes to the unitary fiberglass housing during installation of the pool cover system at the pool site.

8. The method of claim 1 wherein the unitary fiberglass housing includes an open first end and an open second end.

9. The method of claim 8 further comprising securing end caps to the open first end and the open second end.

10. The method of claim 1 further comprising forming the unitary fiberglass housing at the manufacturing facility.

11. A method of delivering a pool cover system:

providing a unitary housing at a manufacturing facility, the unitary housing including a bottom wall, a first side wall extending vertically upward from the bottom wall, a second side wall opposite the first side wall extending vertically upward from the bottom wall, and an open top such that the unitary housing forms a trough;

assembling pool cover system components within the trough of the unitary housing at the manufacturing facility, the assembling step including securing the pool cover system components to at least one of the first and second side wall; and delivering the unitary housing with assembled pool cover system components from the manufacturing facility to a pool site for installation of the pool cover system, wherein the unitary housing is used as a shipping container for the pool cover system during delivery to the pool site.

12. The method of claim 11 wherein the forming step includes forming a plurality of unitary housings each having different lengths and the assembling step includes selecting one of the plurality of unitary housings based on length requirements for the pool site.

13. The method of claim 11 further comprising securing a riser panel to the unitary housing and a lid panel to the riser panel prior to delivering the unitary housing with assembled pool cover system components to the pool site.

14. The method of claim 13 wherein:

the unitary housing includes a first flange extending from a top end of the first side wall and a second flange extending from a top end of the second side wall; and the riser panel includes at least a first slot extending at least partially around the riser panel, the method further comprising securing the riser panel to the unitary housing by connecting a first portion of each of a plurality of brackets to the first slot and a second portion of each of the plurality of brackets to one of the first flange and the second flange.

15. The method of claim 14 wherein the positioning of the first slot in the riser panel is selected to correspond to coping dimensions of a pool such that a height in which an installer will pour concrete will be the same for both the pool and the riser panel.

16. The method of claim 11 wherein the unitary housing includes a flange extending outward from a top end of the first side wall, the method further comprising securing a plurality of spaced apart support blocks on a bottom surface of the flange for securing ground stakes to the unitary housing during installation of the pool cover system at the pool site.

17. The method of claim 11 wherein the unitary housing includes an open first end and an open second end.

18. The method of claim 17 further comprising securing end caps to the open first end and the open second end.

19. The method of claim 11 further comprising forming the unitary housing at the manufacturing facility.

* * * * *